US008079335B2

(12) United States Patent
Rollinger et al.

(10) Patent No.: US 8,079,335 B2
(45) Date of Patent: Dec. 20, 2011

(54) INFERRED OIL RESPONSIVENESS USING PRESSURE SENSOR PULSES

(75) Inventors: John Eric Rollinger, Sterling Heights, MI (US); Jeffrey Allen Doering, Canton, MI (US); Robert Andrew Wade, Dearborn, MI (US); William Russell Goodwin, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 119 days.

(21) Appl. No.: 12/561,702

(22) Filed: Sep. 17, 2009

(65) Prior Publication Data

US 2011/0066357 A1 Mar. 17, 2011

(51) Int. Cl.
*F01L 1/34* (2006.01)

(52) U.S. Cl. ..... 123/90.17; 123/90.15

(58) Field of Classification Search ..... 123/90.15, 123/90.17, 90.16, 90.31, 196 R
See application file for complete search history.

(56) References Cited

U.S. PATENT DOCUMENTS

| | | | | |
|---|---|---|---|---|
| 5,577,399 | A * | 11/1996 | Whipple et al. | 68/12.02 |
| 6,286,532 | B1 | 9/2001 | van Nieuwstadt et al. | |
| 6,497,205 | B2 | 12/2002 | Kumaki et al. | |
| 6,688,282 | B1 | 2/2004 | Okubo et al. | |
| 6,701,246 | B2 | 3/2004 | Riedle et al. | |
| 6,755,165 | B2 | 6/2004 | Kondou et al. | |
| 6,901,788 | B2 | 6/2005 | Han et al. | |
| 7,107,828 | B2 | 9/2006 | Falkowski et al. | |
| 7,128,044 | B1 | 10/2006 | Doering et al. | |
| 2003/0089322 | A1 * | 5/2003 | Dinkel et al. | 123/90.13 |
| 2004/0187835 | A1 * | 9/2004 | Hoff et al. | 123/196 R |
| 2005/0005886 | A1 * | 1/2005 | Jiang | 123/90.17 |
| 2008/0127718 | A1 | 6/2008 | Lesieur | |

FOREIGN PATENT DOCUMENTS

JP 2008065423 A * 3/2008

OTHER PUBLICATIONS

Abstract of JP 2008065423A listed above, Mar. 2008.*
T. Han, et al., Engine Oil Viscometer Based on Oil Pressure Sensor, SAE Technical Paper Series, 2006-01-0701, ISSN 0148-7191.

* cited by examiner

*Primary Examiner* — Zelalem Eshete
(74) *Attorney, Agent, or Firm* — Allan J. Lippa; Brooks Kushman P.C.

(57) ABSTRACT

A system and method for controlling an internal combustion engine include determining oil responsiveness based on pressure variations associated with oil pump pulses in response to a stimulus, and controlling the engine based on the determined oil responsiveness. The stimulus may be a change in oil temperature, engine speed, or commanded pump pressure, for example. The system and method may also use the rate of change of mean oil pressure to determine the oil responsiveness or measure of oil viscosity. Oil responsiveness may be used to control hydraulic actuators, such as variable cam timing devices, or valve deactivation devices.

17 Claims, 5 Drawing Sheets

INFERRED OIL RESPONSIVENESS USING PRESSURE SENSOR PULSES

BACKGROUND

1. Technical Field

The present disclosure relates to determining oil responsiveness and viscosity for use in control and diagnostics of an internal combustion engine and other applications having hydraulic actuators.

2. Background Art

Hydraulic actuation systems have a response that varies not only with oil pressure, but also with how fast oil pressure can change in response to a command. Fluid viscosity of the oil is a significant factor in the ability to raise or lower oil pressure. Various prior art strategies determine or estimate oil viscosity based on steady-state (or DC) oil pressure relationships that occur under specific and generally infrequent operating conditions or ranges, which delays availability of the viscosity determinations. In addition, strategies using only steady-state measurements are vulnerable to long-term drift or offset in measurement values provided by the oil pressure sensing system.

To improve control and diagnostics of hydraulic actuators, it is desirable to have a real-time strategy for robustly detecting the effective responsiveness or inferred viscosity of the oil under various system and ambient operating conditions. For internal combustion engine applications, hydraulic actuators may include a variable cam timing device, or valve deactivation system, such as used in variable displacement engines, for example.

SUMMARY

A system and method for controlling an internal combustion engine include determining oil responsiveness based on amplitude of pressure variations associated with oil pump pulses and oil temperature, and controlling the engine based on the determined oil responsiveness. The system and method may also use mean oil pressure and rate of change of mean oil pressure to determine the oil responsiveness.

In one embodiment, a system for controlling an engine having an oil pump includes an oil pressure sensor coupled to an oil supply line in a position relative to the oil pump to detect pressure pulses originating from the oil pump. The system also includes a hydraulic actuator selectively controlled by pressurized oil from the oil pump, such as a variable cam timing device and/or a gas exchange valve deactivation device. A controller determines oil responsiveness based on amplitude of the pressure pulses and controls the hydraulic actuator based on the determined oil responsiveness. In one embodiment, oil responsiveness can be used to adjust the gain in a closed loop pump pressure control system for a variable displacement oil pump.

Embodiments of the present disclosure provide various advantages. For example, determination of oil responsiveness according to the present disclosure provides various noise immunity benefits relative to virtual viscometers that rely solely on steady-state (DC) oil pressure relationships. Use of oil pump pulse amplitude information provides a readily available oil responsiveness or viscosity determination and can provide a large amount of information to allow averaging of sensor readings under more operating and ambient conditions. Oil responsiveness information determined according to the present disclosure may be used for diagnostics, or to modify or disable control of various oil pressure dependent devices.

The above advantages and other advantages and features of associated with the present disclosure will be readily apparent from the following detailed description of the preferred embodiments when taken in connection with the accompanying drawings.

DETAILED DESCRIPTION

As those of ordinary skill in the art will understand, various features illustrated and described with reference to any one of the Figures may be combined with features illustrated in one or more other Figures to produce embodiments that are not explicitly illustrated or described. The combinations of features illustrated provide representative embodiments for typical applications. However, various combinations and modifications of the features consistent with the teachings of this disclosure may be desired for particular applications or implementations.

Figure 1:
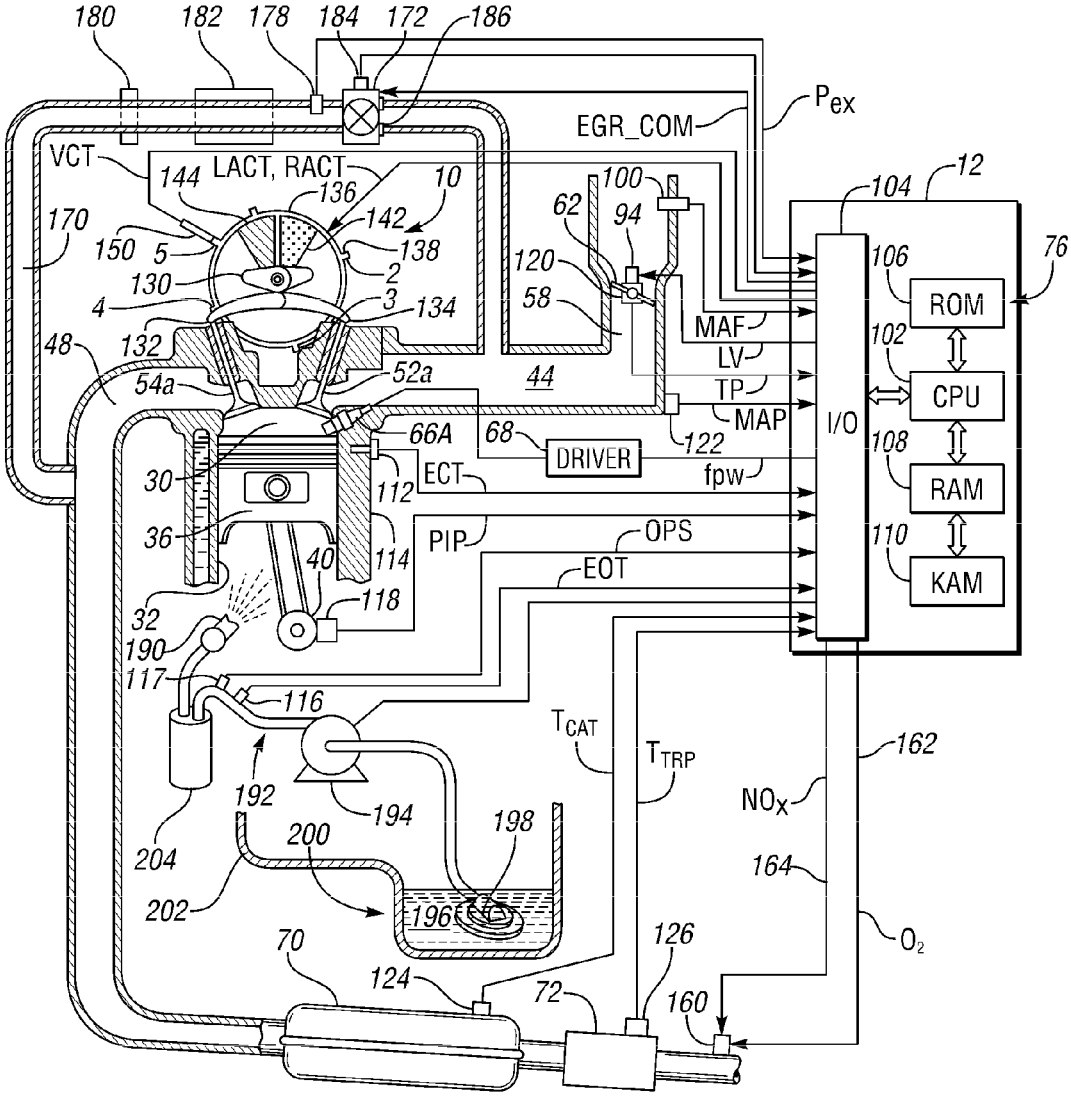
FIG. 1 is a block diagram illustrating operation of a system or method for determining oil responsiveness in a representative embodiment according to the present disclosure.

As illustrated in FIG. 1, internal combustion engine 10 includes a plurality of combustion chambers 30 and is controlled by an electronic engine controller 12. In the illustrated embodiment, engine 10 is a compression-ignition internal combustion engine with direct injection. Those of ordinary skill in the art will recognize that the determination of oil responsiveness according to the present disclosure may be used for control and diagnostics of various types of hydraulic actuators that may be used on various types of internal combustion engines, or in other applications. The teachings of the present disclosure are generally independent of the particular type of hydraulic actuator and/or internal combustion engine. Representative actuators for compression ignition and spark ignition engines may include a variable cam timing (VCT) device, or a valve deactivation device, which may be used in variable displacement engine (VDE) applications, for example.

Combustion chamber 30 includes combustion chamber walls 32 with piston 36 positioned therein and connected to crankshaft 40. Combustion chamber or cylinder 30 communicates with intake manifold 44 and exhaust manifold 48 via respective intake valves 52*a* and 52*b* (not shown), and exhaust valves 54*a* and 54*b* (not shown). Fuel injector 66A is directly coupled to combustion chamber 30 for delivering liquid fuel directly therein in proportion to the pulse width of signal fpw received from controller 12 via conventional electronic driver 68. Fuel is delivered to fuel injector 66A by a high-pressure fuel system (not shown) including a fuel tank, fuel pumps and a fuel rail as well known.

Intake manifold 44 communicates with throttle body 58 via throttle valve or plate 62. In this particular example, throttle plate 62 is coupled to electric motor 94 so that the position of throttle plate 62 is controlled by controller 12 via electric motor 94. This configuration is commonly referred to as electronic throttle control (ETC), which is also utilized to control fresh airflow and EGR flow as described herein.

Exhaust aftertreatment devices may include a nitrogen oxide (NOx) catalyst 70 positioned upstream of a particulate filter 72. NOx catalyst 70 reduces NOx when engine 10 is operating lean of stoichiometry as well known.

Controller 12 is a conventional microcomputer having a microprocessor unit 102, input/output ports 104, and computer readable or electronic storage media 76 for storing data representing code or executable instructions and calibration values. Computer readable storage media 76 may include memory devices functioning as read-only memory 106, random access memory 108, and keep-alive memory 110, for example, in communication with microprocessor unit (CPU) 102 via a conventional data bus. Controller 12 receives various signals from sensors coupled to engine 10 that may include: mass airflow (MAF) from mass airflow sensor 100 coupled to throttle body 58; engine coolant temperature (ECT) from temperature sensor 112 coupled to cooling jacket 114; engine oil temperature (EOT) from temperature sensor 116 coupled to lubrication system 192; engine oil pressure (OPS) from pressure sensor 117 coupled to lubrication system 192; profile ignition pickup signal (PIP) from Hall effect sensor 118 coupled to crankshaft 40; throttle position (TP) from throttle position sensor 120; and absolute manifold pressure (MAP) from sensor 122. Engine speed signal (RPM) is generated by controller 12 from signal PIP in a conventional manner. Manifold pressure signal MAP from a manifold pressure sensor provides an indication of vacuum, or pressure, in the intake manifold. Hall effect sensor 118 may also be used as an engine speed sensor and produces a predetermined number of equally spaced pulses every revolution of the crankshaft.

The exhaust and/or emission control system may include various sensors to provide corresponding signals such as catalyst temperature Tcat provided by temperature sensor 124 and temperature Ttrp provided by temperature sensor 126.

Continuing with FIG. 1, engine 10 includes one or more hydraulic actuators 128 that may be affected by a change in oil responsiveness. In the representative embodiment illustrated, hydraulic actuator 128 includes a variable cam timing (VCT) device and/or a valve deactivation device as described in greater detail herein. Operation of hydraulic actuators 128 may be affected by oil responsiveness, which may be determined or estimated according to the present disclosure. The current oil responsiveness may be used to adjust or modify control of the actuator(s) to provide more consistent and predictable operation of the actuator(s) as oil responsiveness changes due to changes in ambient and/or operating conditions and/or oil condition.

As shown in FIG. 1, camshaft 130 of engine 10 is coupled to rocker arms 132 and 134 for actuating intake valves 52*a*, 52*b* and exhaust valves 54*a*, 54*b*. Camshaft 130 is directly coupled to housing 136. Housing 136 forms a toothed wheel having a plurality of teeth 138. Housing 136 is hydraulically coupled to an inner shaft (not shown), which is in turn directly linked to camshaft 130 via a timing chain (not shown). Therefore, housing 136 and camshaft 130 rotate at a speed substantially equivalent to the inner camshaft. The inner camshaft rotates at a constant speed ratio to crankshaft 40. However, by manipulation of the hydraulic coupling, the relative position of camshaft 130 to crankshaft 40 can be varied by hydraulic pressures in advance chamber 142 and retard chamber 144. By allowing high pressure hydraulic fluid to enter advance chamber 142, the relative relationship between camshaft 130 and crankshaft 40 is advanced. Thus, intake valves 52*a*, 52*b* and exhaust valves 54*a*,54*b* open and close at a time earlier than normal relative to crankshaft 40. Similarly, by allowing high pressure hydraulic fluid to enter retard chamber 144, the relative relationship between camshaft 130 and crankshaft 40 is retarded. Thus, intake valves 52*a*, 52*b*, and exhaust valves 54*a*, 54*b* open and close at a time later than normal relative to crankshaft 40.

Teeth 138, being coupled to housing 136 and camshaft 130, allow for measurement of relative cam position via cam timing sensor 150 providing signal VCT to controller 12. Teeth 1, 2, 3 and 4 are used for measurement of cam timing and are equally spaced (for example, in a V-8 dual-bank engine, spaced 90 degrees apart from one another) while tooth 5 is preferably used for cylinder identification. In addition, controller 12 sends control signals (LACT,RACT) to conventional solenoid valves (not shown) to control the flow of hydraulic fluid either into advance chamber 142, retard chamber 144, or neither.

Relative cam timing may be determined using known techniques. Generally, the time or rotation angle between the rising edge of the PIP signal and receiving a signal from one of the plurality of teeth 138 on housing 136 gives a measure of the relative cam timing. For the particular example of a V-8 engine, with two cylinder banks and a five-toothed wheel, a measure of cam timing for a particular bank is received four times per revolution, with the extra signal used for cylinder identification.

Engine 10 generally includes a conventional force-fed lubrication system 192 in combination with splash and oil mist lubrication to provide lubrication to moving components and to power various hydraulic components, such as hydraulic actuator 128. In the illustrated embodiment, hydraulic actuator 128 is powered by pressurized lubricating oil 196 from lubrication system 192. Oil pump 194 pumps oil 196 through a pick-up tube 198 placed within sump portion 200 of oil pan 202. Pump 194 delivers pressurized oil through oil filter 204 to oil gallery 190 of engine 10. Pump 194 may be a gear-driven pump, multiple-lobe pump driven directly or indirectly by rotation of crankshaft 40. In one embodiment, pump 194 communicates with controller 12 to provide closed loop pump pressure control based on the oil responsiveness with feedback provided by pressure sensor 117. Controller 12 may provide an adjustable gain for the closed loop control based on the current oil responsiveness.

As those of ordinary skill in the art will appreciate, oil pressure sensor 117 is coupled to an oil supply line in a position near oil pump 194 to detect pressure pulses originating from oil pump 194. The actual position may vary depending upon the particular application and implementation. In general, it is desirable to place pressure sensor 117 as close as possible to pump 194 without intervening components that may damp or attenuate the higher frequency or AC components of the oil pressure signal with signal filtering provided by software or code implemented by controller 12. In the illustrated embodiment, oil pressure sensor 117 is positioned between oil pump 194 and oil filter 204.

As also shown in FIG. 1, the exhaust system may include a sensor 160 that provides an indication of both oxygen concentration in the exhaust gas as well as NOx concentration. Signal 162 provides controller 12 a voltage indicative of the oxygen concentration, while signal 164 provides a voltage indicative of NOx concentration.

Engine 10 may include an exhaust gas recirculation system having an exhaust passage 170 that allows exhaust gas to flow from exhaust manifold 48 to intake manifold 44. In some applications, exhaust passage 170 may include an EGR catalyst and/or particulate filter 180 and EGR cooler 182. An EGR valve 172 is also disposed within exhaust passage 170, and may be implemented by a linear solenoid valve or DC motor, for example. Valve 172 receives a command signal (EGR_COM) from controller 12 and may include an integral valve position sensor 184 to provide a feedback signal for closed loop control. Exhaust pressure (or backpressure) sensor 174 is positioned upstream of valve 172. Sensor 174 provides an indication of exhaust pressure to controller 12 and may be used in controlling operation of EGR valve 172

Another example of a hydraulic actuator that may use oil responsiveness information for control and/or diagnostics according to the present disclosure is a gas exchange valve deactivation device. Valve deactivation devices may be used to selectively deactivate or disable intake and/or exhaust valves of one or more cylinders during operation to improve efficiency. Depending on the particular application and implementation, intake valves and/or exhaust valves may be deactivated using a corresponding hydraulic deactivation device. For variable displacement engine (VDE) applications, cylinders may be deactivated or disabled under low load conditions, such as at idle, deceleration and while maintaining cruising speed (e.g., highway driving) to improve engine efficiency and fuel economy resulting from a reduction in pumping losses that occurs when one or more cylinders are disabled. When cylinders are disabled, cylinder intake and/or exhaust valves typically are disabled, allowing the engine to operate at a higher manifold pressure (e.g., with a wider throttle) to supply the needed airflow to the operating cylinders. The higher pressure reduces the pumping load on the operating cylinders. Also, instead of working against the vacuum in the intake manifold, the disabled cylinders are aided while returning to bottom dead center by the "air spring" effect resulting from sealing off the cylinder. Typically, fuel delivery (and spark for spark-ignited engines) is also interrupted when cylinders are disabled.

In cam-based engines, various methods may be employed to disable cylinder intake and/or exhaust valves that may be affected by a change in oil responsiveness. Transfer of motion from a cam lobe to a valve stem may be interrupted by using a controlled squirt of oil to slide a disabling pin inside selected valve lifters or rocker arms. In pushrod applications, the outer portion of each disabled lifter telescopes over the inner portion to maintain contact with the cam lobe without opening the valve. Similar to cam lobe or profile switching schemes, the disabling pin may be used to select a rocker arm alignment that provides no valve lift. Various control parameters may be adjusted to adapt to current oil responsiveness to provide more consistent control of these actuators across wide-ranging ambient and engine operating conditions according to the present disclosure.

Figure 2:
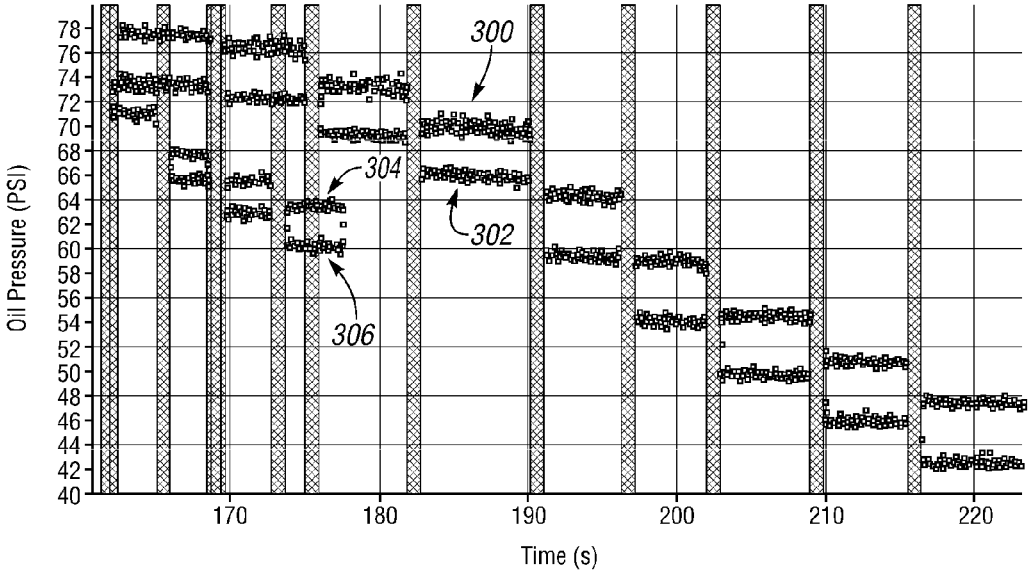
FIG. 2 provides representative oil pressure data illustrating oil responsiveness during a warm-up cycle.

FIG. 2 provides representative oil pressure data illustrating oil responsiveness as a function of time during a warm-up cycle. Data points 300 and 302 correspond to maximum and minimum oil pressure values for data samples of oil having a viscosity of SAE 5W20 to demonstrate behavior of oil having a first responsiveness. Data points 304 and 306 correspond to maximum and minimum oil pressure values for data samples of oil having a thicker viscosity of 15W50 to demonstrate behavior of oil having a second responsiveness. The minimum and maximum values correspond to the peak-to-peak amplitude for the oscillatory (AC) or higher frequency components of the oil pressure sensor signal associated with oil pump pulses and their variation in response to a stimulus, such as a change in oil temperature or engine speed, for example. As illustrated in FIG. 2, the peak-to-peak amplitude of the oil pump pulses 300, 302 for the thinner or lower viscosity oil is greater than the peak-to-peak amplitude of the oil pump pulses 304, 306 of the thicker, higher viscosity oil, which is less responsive. Furthermore, the peak-to peak amplitude 300,302 generally increases with respect to time as the oil temperature increases and the oil becomes more responsive (or less viscous). A measure of oil responsiveness may also be made from the rate of change of the low frequency or steady-state (DC) value of the oil pressure pump pulsations. Once a determination of oil responsiveness is made, the control system may adjust various control parameters in response. For example, feed-forward terms or system gain may be adjusted to ameliorate the effects of more viscous oil and provide more consistent system response times for hydraulically actuated systems across a wider range of engine/ambient operating conditions.

Depending upon the particular application and implementation, the oil pressure sensor signal may be sampled synchronously relative to a vehicle event, such as crank angle rotation, or asynchronously. The sampling rate and filtering may be selected to reduce or eliminate noise while preserving the AC component of the signal corresponding to pressure pulsations of the oil pump for use in determining oil responsiveness. The sampling and filtering may vary depending on a number of considerations such as the placement of the oil pressure sensor relative to the oil pump, the type of oil pump, the number of pump lobes, and the intended use of the oil responsiveness determination, for example.

Figure 3:
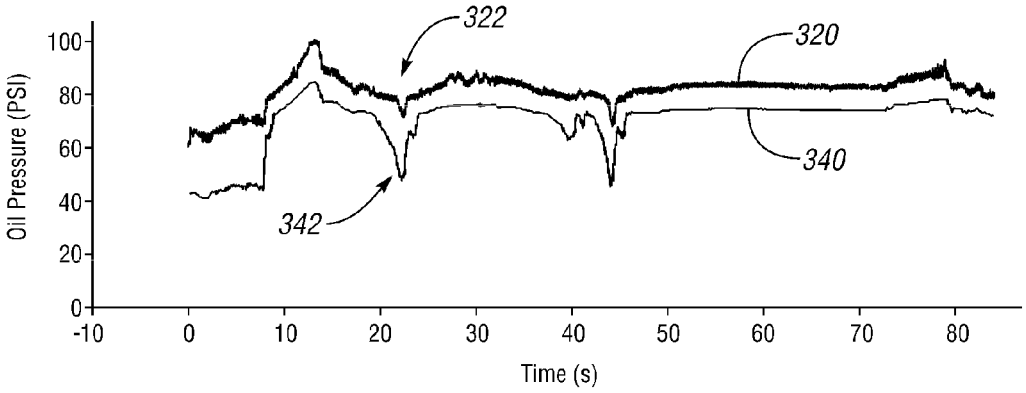
FIG. 3 provides representative oil pressure data illustrating oil responsiveness during transient maneuvers.

FIG. 3 provides representative oil pressure data illustrating oil responsiveness during engine speed transient maneuvers. Line 320 corresponds to oil having a higher or thicker viscosity corresponding to SAE 20W50 at 200 F. Line 340 corresponds to an estimated or inferred responsiveness corresponding to oil having a lower or thinner viscosity corresponding to SAE 10W30 at 200 F. Line 320 exhibits a higher DC or steady-state oil pressure while also exhibiting a lower dynamic or AC response compared to the more responsive (less viscous) oil as represented by line 340. For example, the less-responsive oil shows a smaller drop in pressure at 322 compared to the more-responsive oil at 342 for the same change in engine speed.

Figure 4:
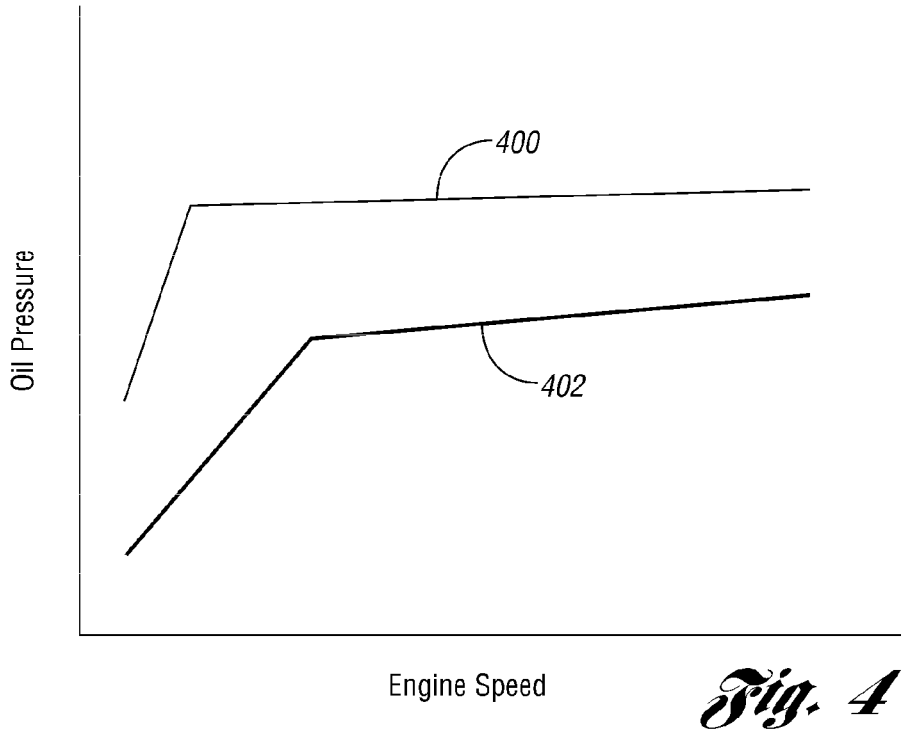
FIG. 4 is a graph illustrating change in DC values of oil pressure as a function of engine speed for different oil responsiveness.

FIG. 4 is a graph illustrating change in steady-state (DC) values of oil pressure as a function of engine speed for different oil responsiveness and a constant engine oil temperature. Line 400 represents oil having a slower response or being less responsive (thicker) than oil characterized by line 402, which is more responsive (thinner).

Figure 5:
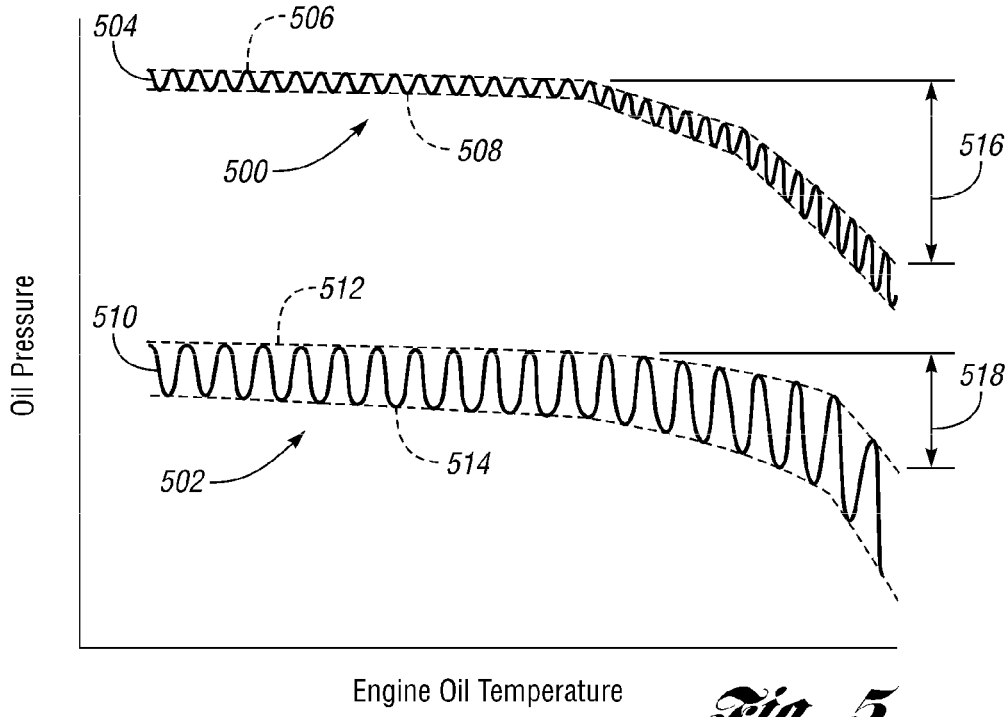
FIG. 5 is a graph illustrating change in values of oil pressure as a function of oil temperature for different oil responsiveness.

FIG. 5 is a graph illustrating change in values of oil pressure as a function of oil temperature for different oil responsiveness. Data 500 illustrates behavior of less responsive oil while data 502 illustrates behavior of more responsive oil. Lines 504, 510 represent the analog oil pressure signal associated with oil pump pulses in response to the stimulus of changing oil temperature for less responsive oil and more responsive oil, respectively. Similarly, lines 506, 512 represent the maxima with lines 508, 514 representing the minima of the AC component of the corresponding pressure sensor signals. A peak-to-peak value can be determined from the maxima and associated minima. The DC or steady-state change is represented by reference numerals 516, 518 and may also be used in determining the oil responsiveness. As illustrated in FIG. 5, the less responsive (thicker) oil represented by signal 504 has a smaller peak-to-peak or AC component relative to the more responsive (thinner) oil represented by signal 510. However, signal 504 has a higher DC value and higher rate of change of DC value as a function of temperature as represented by delta DC 516 compared to delta DC 518 over the same change in oil temperature.

Figure 6:
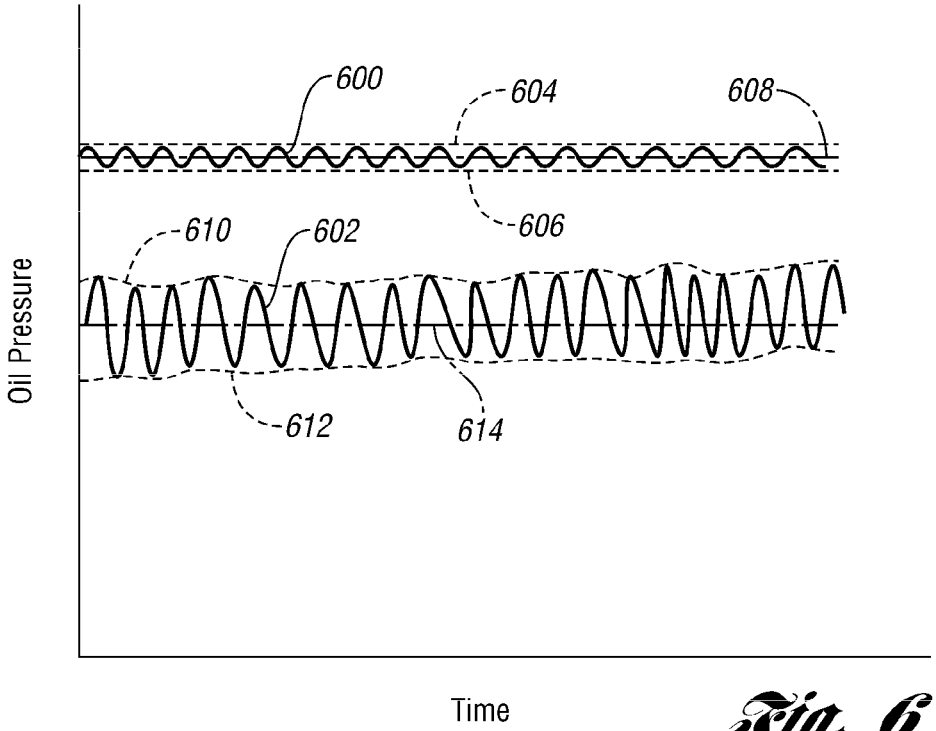
FIG. 6 is a graph illustrating change in values of oil pressure as a function of time for different oil responsiveness.

FIG. 6 is a graph illustrating change in values of oil pressure as a function of time for different oil responsiveness at a constant engine speed and oil temperature. Similar to FIG. 5, lines 600, 610 represent the analog oil pressure sensor signal illustrating pressure pulsations associated with the oil pump for a less responsive oil and more responsive oil, respectively. Lines 604, 610 correspond to the associated maxima with lines 606, 612 representing the minima used in determining a peak-to-peak value of the AC component of the pressure signals. Lines 608 and 610 represent the respective average or mean values. Again, the less responsive oil represented by signal 600 has a higher DC value and lower AC peak-to-peak relative to the corresponding signal characteristics of the more responsive oil represented by signal 602.

Figure 7:
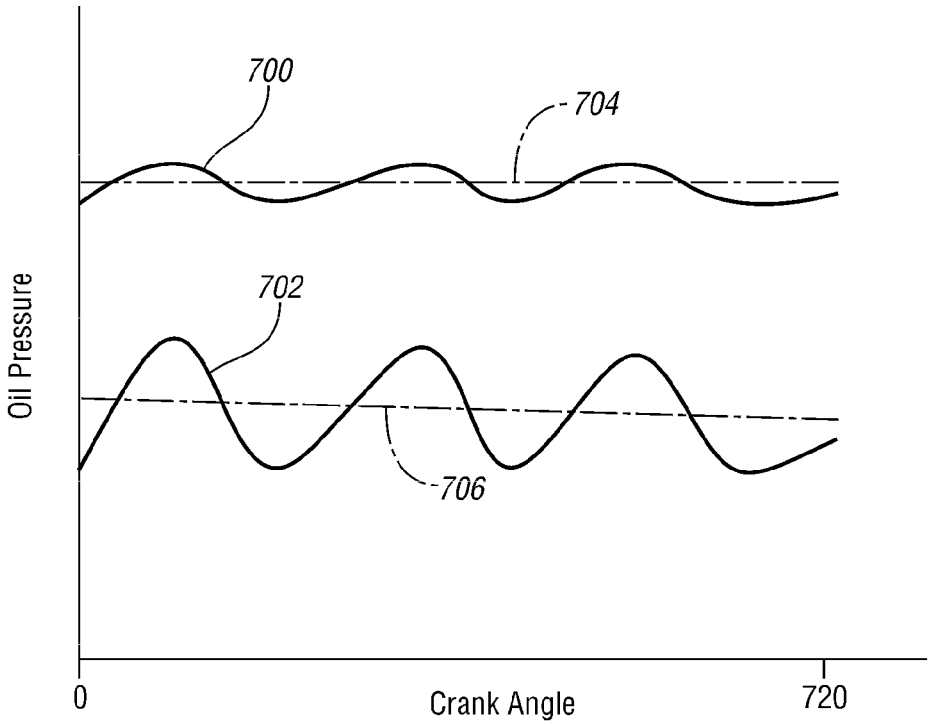
FIG. 7 is a graph of an oil pressure sensor signal for a single combustion cycle illustrating different oil responsiveness.

FIG. 7 is a graph of an oil pressure sensor signal for a single combustion cycle illustrating different oil responsiveness at a constant engine speed and engine oil temperature. Signals 700, 702 illustrate pressure pulsations associated with a three-lobe oil pump over 720 degrees of crank angle rotation. Again, the less responsive oil signal 700 has a higher DC value 704 and lower peak-to-peak variation of the AC component compared to peak-to-peak variation and DC value 706 of signal 702.

Figure 8:
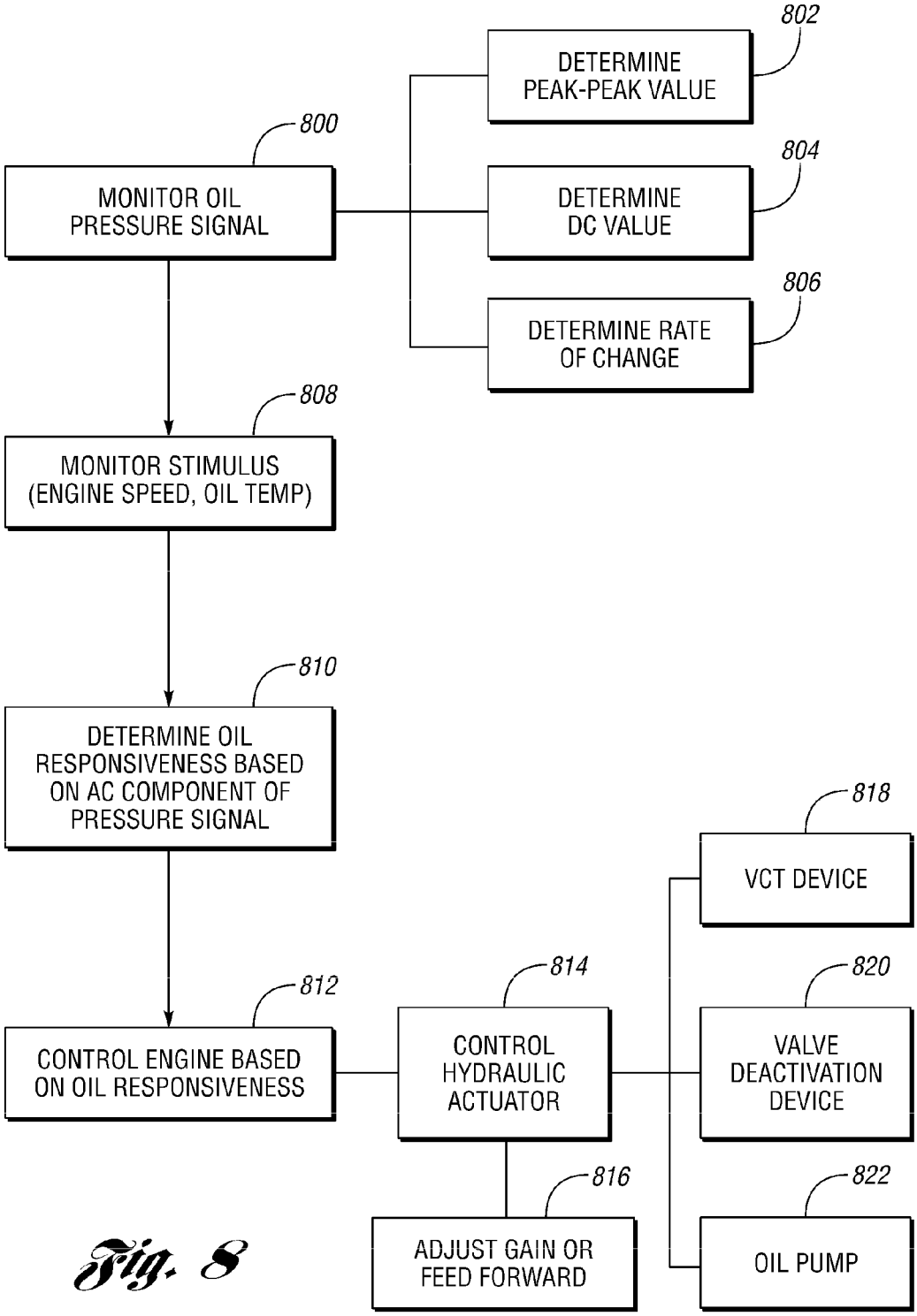
FIG. 8 is a flow chart illustrating operation of a system or method for determining oil responsiveness and controlling a hydraulic actuator that may be used in an internal combustion engine according to embodiments of the present disclosure.

FIG. 8 is a flow chart illustrating operation of a system or method for determining oil responsiveness and controlling a hydraulic actuator that may be used in an internal combustion engine according to embodiments of the present disclosure. The diagram of FIG. 8 provides a representative control strategy for an internal combustion engine having one or more hydraulically actuated or oil dependent devices, such as a VCT device and/or valve deactivation device, for example. The control strategy and/or logic illustrated in FIG. 8 is generally stored as code implemented by software and/or hardware in controller 12. Code may be processed using any of a number of known strategies such as event-driven, interrupt-driven, multi-tasking, multi-threading, and the like. As such, various steps or functions illustrated may be performed in the sequence illustrated, in parallel, or in some cases omitted. Although not explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description.

Preferably, the control logic or code represented by the simplified flow chart of FIG. 8 is implemented primarily in software with instructions executed by a microprocessor-based vehicle, engine, and/or powertrain controller, such as controller 12 (FIG. 1). Of course, the control logic may be implemented in software, hardware, or a combination of software and hardware in one or more controllers or equivalent electronics depending upon the particular application. When implemented in software, the control logic is preferably provided in one or more computer-readable storage media having stored data representing code or instructions executed by a computer to control one or more components of the engine. The computer-readable storage media may include one or more of a number of known physical devices which utilize electric, magnetic, optical, and/or hybrid storage to keep executable instructions and associated calibration information, operating variables, and the like.

A measured or estimated oil pressure signal is monitored as represented by block 800. The oil pressure signal is processed or analyzed to monitor various signal characteristics that may include peak-to-peak values as represented by block 802, DC or steady-state values as represented by block 804, and a rate of change of one or more values as represented by block 806. As previously described, the AC component of the oil pressure signal generally corresponds to the oil pump pulses. The various signal characteristics will change in response to a stimulus as represented by block 808. Representative stimuli include a change in engine speed, engine oil temperature, or oil condition, for example. The response of one or more oil pressure signal characteristics to the stimulus is monitored to determine the oil responsiveness as represented by block 810. The oil responsiveness determination may be based on the one or more of the peak-to-peak values 802, average DC value 804, and/or rate of change of any characteristic 806, in addition to the engine speed and/or oil temperature. The engine is then controlled based on the determination of the oil responsiveness as represented by block 812.

As also illustrated in FIG. 8, one or more hydraulic actuators may be controlled based on the determination of the oil responsiveness as represented by block 814. In one embodiment, one or more control parameters are adjusted or modified, such as a gain or feedforward term as represented by block 816, for example. Representative hydraulic actuators may include a VCT device 818, a valve deactivation device 820, or a variable displacement oil pump 822, for example.

As the embodiments described above illustrate, the present disclosure provides various advantages. For example, determination of oil responsiveness according to the present disclosure provides various noise immunity benefits relative to virtual viscometers that rely solely on steady-state (DC) oil pressure relationships. Use of oil pump pulse amplitude information provides a readily available oil responsiveness or viscosity determination and can provide a large amount of information to allow averaging of sensor readings under a wide range of operating and ambient conditions. Oil responsiveness information determined according to the present disclosure may be used for diagnostics, or to modify or disable control of various oil pressure dependent or hydraulically actuated devices.

While one or more embodiments have been illustrated and described, it is not intended that these embodiments illustrate and describe all possible embodiments within the scope of the claims. Rather, the words used in the specification are words of description rather than limitation, and various changes may be made without departing from the spirit and scope of the disclosure. While various embodiments may have been described as providing advantages or being preferred over other embodiments or prior art implementations with respect to one or more desired characteristics, as one skilled in the art is aware, one or more features or characteristics may be compromised to achieve desired overall system attributes, which depend on the specific application and implementation. These attributes include, but are not limited to: cost, strength, durability, life cycle cost, marketability, appearance, packaging, size, serviceability, weight, manufacturability, ease of assembly, etc. Embodiments described as less desirable than other embodiments or prior art implementations with respect to one or more characteristics are not outside the scope of the disclosure and may be desirable for particular applications.

What is claimed:

1. A method for controlling an engine, comprising:

determining oil responsiveness indicative of oil viscosity based on an oscillatory component of an oil pressure signal associated with oil pump pulses in response to a stimulus; and controlling the engine based on the determined oil responsiveness.

2. The method of claim 1 wherein the stimulus comprises a change in at least one of oil temperature and engine speed.

3. The method of claim 1 wherein controlling the engine comprises controlling a hydraulic actuator.

4. The method of claim 3 wherein the hydraulic actuator comprises a variable cam timing device.

5. The method of claim 3 wherein the hydraulic actuator comprises an engine valve deactivation device.

6. The method of claim 1 wherein determining oil responsiveness comprises determining peak-to-peak amplitude of an oil pressure sensor signal.

7. The method of claim 1 wherein controlling the engine comprises controlling a variable displacement oil pump.

8. The method of 7 wherein controlling the oil pump comprises adjusting gain of a closed loop pump pressure control based on the oil responsiveness.

9. The method of claim 1 wherein determining oil responsiveness further comprises determining oil responsiveness based on an average oil pressure, current engine speed, and current oil temperature.

10. The method of claim 1 wherein determining oil responsiveness comprises determining oil responsiveness based on mean oil pressure rate of change.

11. A system for an engine having an oil pump, comprising:

a sensor coupled to an oil supply line near the oil pump to detect pressure pulses originating from the oil pump;

a hydraulic actuator selectively controlled by pressurized oil from the oil pump; and a controller communicating with the sensor and actuator, the controller determining effective oil viscosity using amplitude of the pressure pulses and controlling the hydraulic actuator based on the effective viscosity.

12. The system of claim 11 wherein the controller determines effective oil viscosity based on current oil temperature, current engine speed, and mean oil pressure.

13. The system of claim 12 wherein the controller determines effective oil viscosity based on mean oil pressure rate of change.

14. The system of claim 11 wherein the controller determines effective oil viscosity based on peak-to-peak amplitude of the pressure pulses.

15. The system of claim 11 wherein the hydraulic actuator comprises a variable cam timing device.

16. The system of claim 11 wherein the hydraulic actuator comprises a valve deactivation device.

17. The system of claim 11 wherein the controller determines effective oil viscosity using mean oil pressure and peak-to-peak amplitude of the pressure pulses.

* * * * *